US005799820A

United States Patent [19]

Maas

[11] Patent Number: 5,799,820

[45] Date of Patent: Sep. 1, 1998

[54] MILK/JUICE JUG INSULATOR

[76] Inventor: Alan Francis Maas, 15204 Wildwood Rd., Burnsville, Minn. 55306

[21] Appl. No.: 322,225

[22] Filed: Oct. 13, 1994

[51] Int. Cl.[6] ..... B65D 23/08

[52] U.S. Cl. ..... 220/739; 220/737; 220/903

[58] Field of Search ..... 220/739, 771, 220/753, 903

[56] References Cited

U.S. PATENT DOCUMENTS

| | | | |
|---|---|---|---|
| D. 306,546 | 3/1990 | Coy . | |
| 1,381,071 | 6/1921 | Flannery . | |
| 2,670,616 | 3/1954 | Schneider | 220/737 |
| 2,843,302 | 7/1958 | Bandy | 220/737 |
| 3,285,455 | 11/1966 | Pewitt . | |
| 3,347,404 | 10/1967 | McIntyre | 220/737 |
| 3,406,442 | 10/1968 | Rosat-Gonzalez | 220/739 |
| 3,473,682 | 10/1969 | Studen . | |
| 3,692,346 | 9/1972 | Simms | 220/737 |
| 3,941,237 | 3/1976 | MacGregor, Jr. | 220/737 |
| 4,540,611 | 9/1985 | Henderson . | |
| 4,796,937 | 1/1989 | Andrea . | |
| 4,813,558 | 3/1989 | Fujiyoshi | 220/739 |
| 4,892,215 | 1/1990 | Carlson et al | 220/739 |
| 5,058,757 | 10/1991 | Proa . | |
| 5,188,877 | 2/1993 | Magaro . | |
| 5,207,076 | 5/1993 | Sciarrillo | 220/737 |
| 5,211,307 | 5/1993 | Jeffries | 220/739 |
| 5,222,656 | 6/1993 | Carlson | 220/739 |
| 5,299,700 | 4/1994 | Beniacar | 220/737 |

*Primary Examiner*—Joseph M. Moy

*Attorney, Agent, or Firm*—Merchant, Gould, Smith, Edell, Welter & Schmidt, P.A.

[57] ABSTRACT

An insulating shell for an irregularly shaped container having an integral handle, the shell made of insulating material and having a main body portion into which the container is inserted. One side of the main body portion is taller than the other side, to leave exposed the handle of the container, so it can still be easily lifted. A bottom portion of the shell has one or more holes cut into it, to counteract vacuum effect when removing the container from the shell. The insulating material out of which the shell is made is typically vinyl-coated foam rubber or foam plastic.

10 Claims, 3 Drawing Sheets

MILK/JUICE JUG INSULATOR

BACKGROUND OF THE INVENTION

The ubiquitous one-gallon jug, commonly used to store milk and other beverages, presents a unique dilemma in trying to keep its contents cool. Typically, a one-gallon jug will be removed from the refrigerator and left on the dinner table for easy accessibility for pouring refills during the course of a meal. However, the jug, not usually made from any sort of insulating material, soon loses its original temperature, its contents quickly warming or cooling to the temperature of the surrounding room. With some beverages, like water, this can be just a mere annoyance. However, with others, such as milk, this can be more of a problem, because the beverage itself can spoil if left at room temperature for any length of time. Therefore, there exists a need to insulate the jug to prevent its contents from reverting to room temperature.

Although the prior art in this field of invention begins to address the problem of insulating containers for holding beverages, it does not solve the unique problem presented by the one-gallon or half gallon milk and juice containers. Foremost, many irregularly shaped containers integrate a handle into the design of the container itself. A thermal device meant to keep the contents of such containers at their original temperature thus must work around this, insulating the container while still allowing access to the handle for easy pouring.

SUMMARY OF THE INVENTION

The present invention provides for an enclosure that insulates an irregularly shaped container having an integrated handle. The enclosure includes a shell of insulating material, typically made of vinyl-coated foam rubber or foam plastic, into which the container is placed. The shell covers the container circumferentially around its main body, and also includes a base portion to cover the bottom of the container. However, the shell leaves exposed the handle of the container, so it can still be easily lifted for pouring. Furthermore, the shell includes one or more holes cut into its base portion to allow for easy removal of the container from the shell by counteracting vacuum effect.

DESCRIPTION OF THE PREFERRED EMBODIMENT

Figure 1:
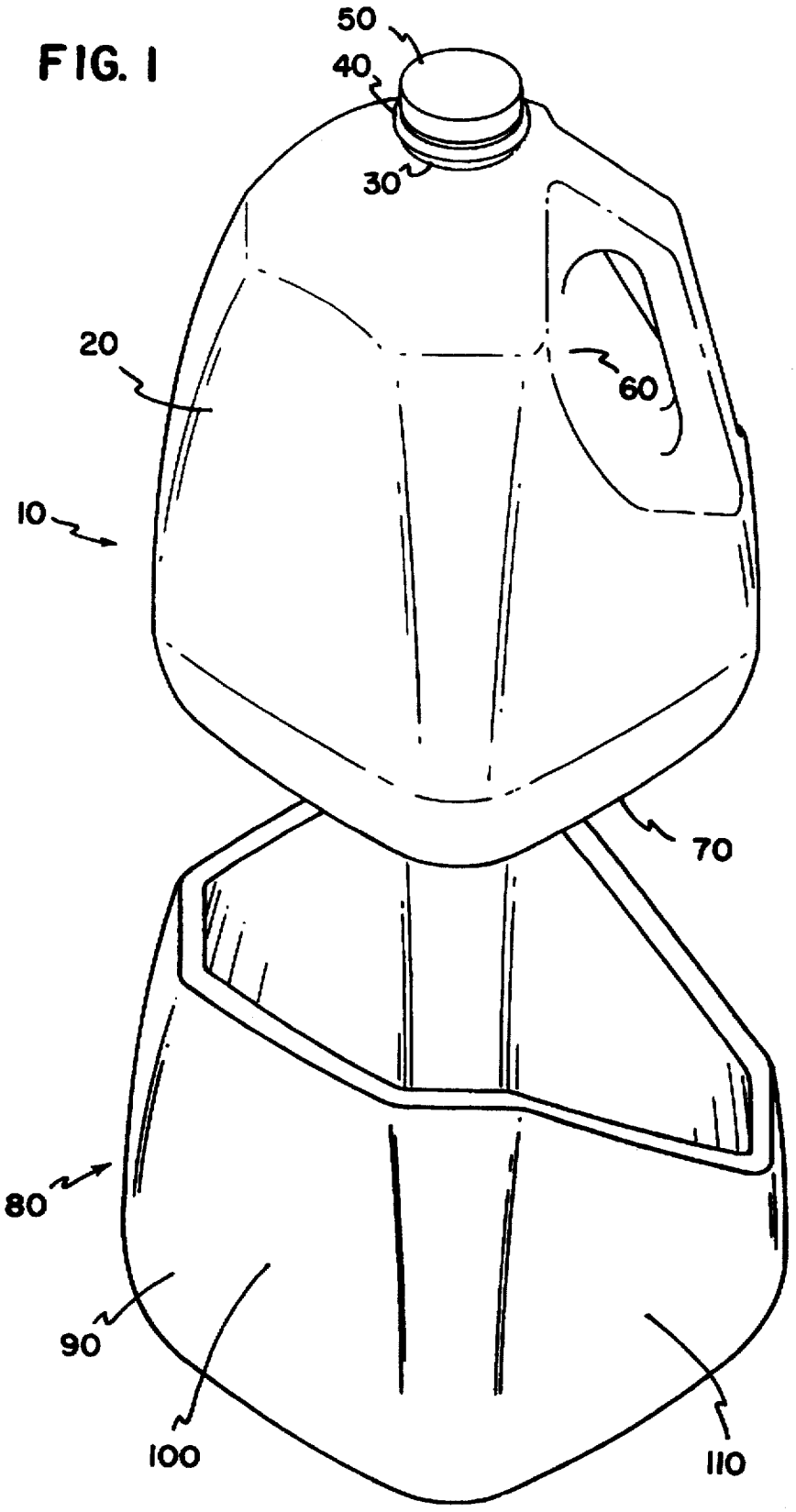
FIG. 1 is a perspective view of a preferred embodiment of the present invention with the container removed.
Figure 2:
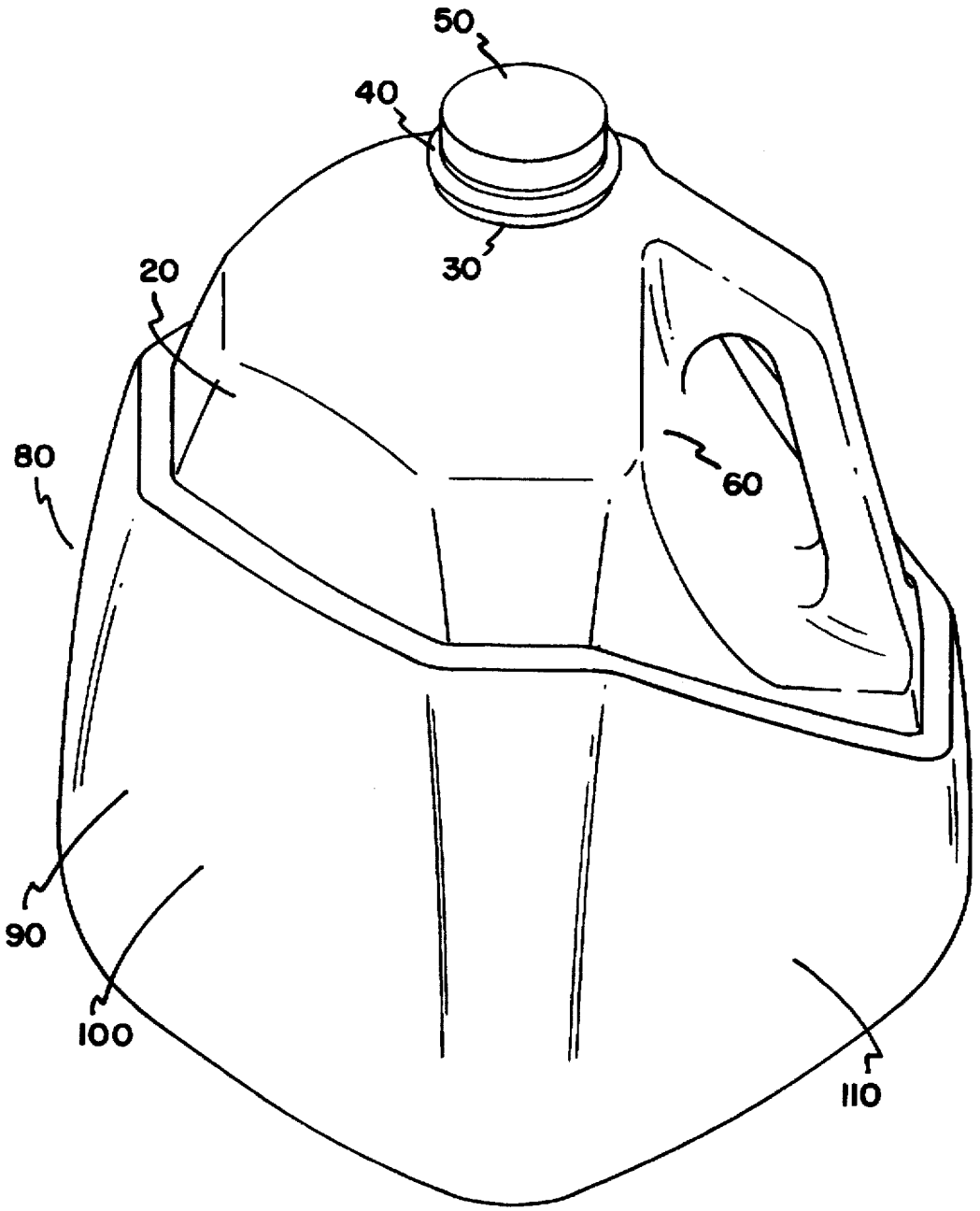
FIG. 2 is a perspective view of a preferred embodiment of the present invention with the container inserted.

With reference to the drawings, FIGS. 1 and 2 show a typical beverage container 10. The container is not part of the present invention. An example of the container is a regular one-gallon milk jug found in nearly all grocery stores and supermarkets.

The container 10 has a main body portion 20 for holding its liquid contents, a neck portion 30 stemming from the main body portion and ending in a usually threaded mouth portion 40 upon which a closure 50 is secured. The neck portion 30 tapers downwardly to a handle portion 60, also connected to the main body portion 20 and by which the container 10 is lifted when moving it or pouring its content liquid. A base portion 70, usually having a slightly concave surface for structural reasons, attaches to the bottom of the main body portion 20. Again, none of these features are part of the present invention.

The insulation shell 80 of the present invention has a main portion 90 which is of the size and shape of the main body portion 20 of the container 10. The main portion is preferably substantially square in horizontal crosssection, and includes side walls 100, 110, 120, and 130. The shell 80 fits the container 10 snugly so that it will not fall off. To use the shell 80, the container 10 is inserted into the shell opening and positioned so that the main portion 90 of the shell fits over the main body portion 20 of the container.

Figure 3:
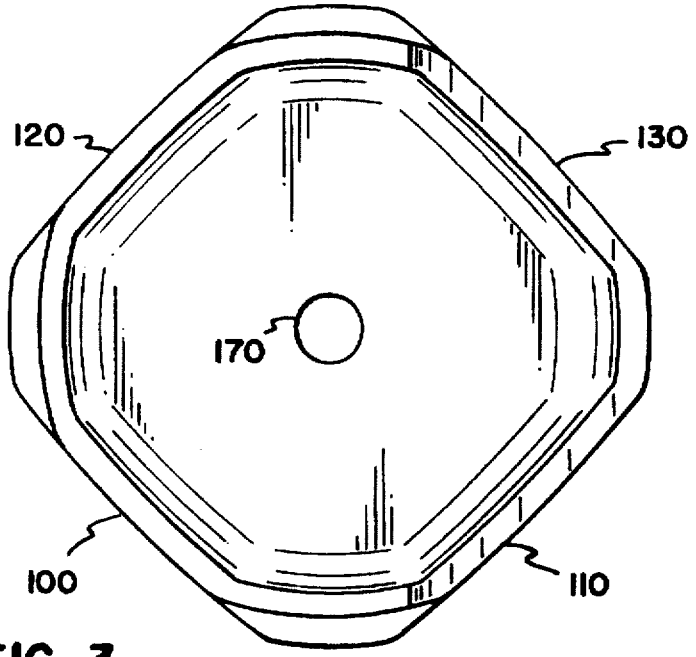
FIG. 3 is a front view of the shell shown in FIG. 1.

Referring to FIG. 3, one side 140 of the main portion 150 is cut higher than the other side, to correspond to the height of the mouth portion 40 of the container 10. This taller side of the main portion 80 then tapers downwardly to the shorter side 150. The shorter side of the main portion 80 is cut to correspond to the height of the handle portion 60 of the container 10. In this way, the shell 80 insulates the container 10 while ensuring access to the handle portion 60, so it can still be easily lifted for pouring. The actual height of both the taller and shorter sides of the container 10 can vary, but the more equal the height of the taller side is to the height of the mouth portion 40 of the container 10, and the more equal the height of the shorter side is to the height of the handle portion 60, the better the insulating effect of the shell 80.

Figure 4:
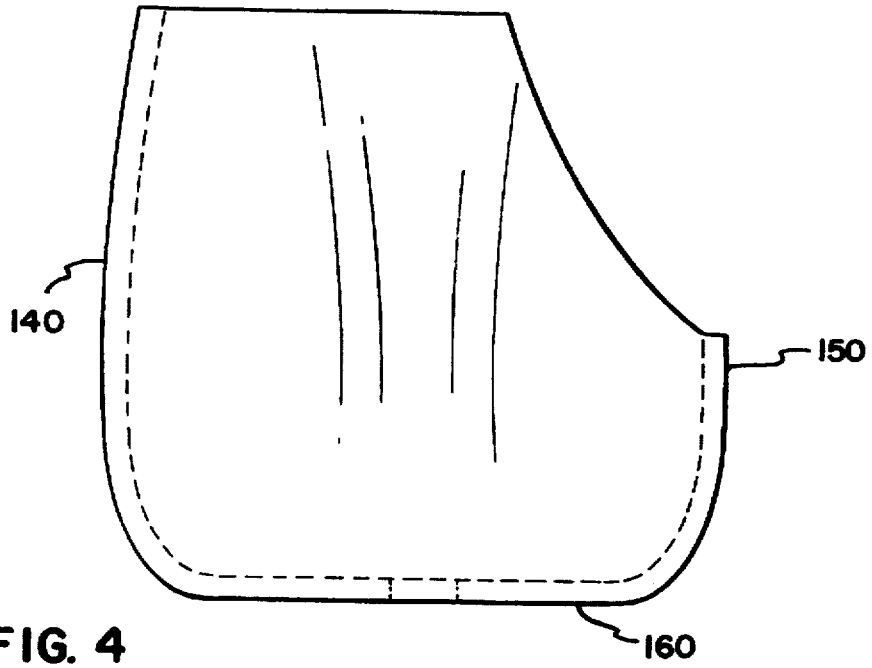
FIG. 4 is a bottom view of the shell shown in FIG. 1.

The shell 80 of the present invention also has a base portion 160 that covers the base portion 70 of the container 10, to further insulate the container. The base portion 160 is preferably integrally formed with main portion 90. Furthermore, as shown in FIG. 4, one or more holes 170 are cut into the base portion 160 of the shell 80. The hole or holes 170 allow for the container 10 to be easily removed from the shell 80 by counteracting vacuum effect, which would otherwise make removal difficult.

As seen in FIG. 3, the shell 80 is made of a thin insulating material. Quite typically, this material can be foam rubber or foam plastic, and can also be vinyl coated. A thickness of approximately one-half inch ensures that the container 10 is well insulated, while not proving too thick to become unwieldy or difficult to handle. Preferably, then, the shell 80 is made of vinyl-coated foam rubber or foam plastic one-half inch in thickness.

While the shell shown corresponds to a typical one gallon milk or juice-jug container and represents the preferred embodiment of the present invention, it should be understood that other shapes conforming to other irregularly shaped containers having an integral handle are covered under the present invention. For example, the invention is suitable for use with half gallon milk jugs, and can be used with jugs made of plastic, cardboard, or other materials. Moreover, orange juice frequently comes in two-quart containers and gallon containers having an irregular, non-cylindrical shape and having an integral handle. Under the present invention, a similar shell could be constructed to fit this type of container as well. Numerous other changes can be made without departing from the spirit and scope of the invention. Therefore, the scope of the invention should be measured not with reference to the preferred embodiment, but to the following claims.

What is claimed is:

1. An enclosure for insulating a container which is non-circular in horizontal cross-section, the container being a one-gallon jug having a base portion, a main body portion, a mouth portion formed at one side of the container, an integral handle portion formed on an opposing side of the container, and a neck portion tapering downwardly from the mouth portion to the handle portion, said enclosure comprising:

a shell of insulating material shaped to hold the container, the shell having an interior space which is non-circular in horizontal cross-section and is of dimensions which substantially correspond to the exterior dimensions of the main body portion of the container, said shell comprising:

(a) a main portion to substantially cover the main body portion of the container to insulate the container contents, one side of the main portion of the shell extending substantially as high as the mouth portion of the container at said one side of the container, said main portion tapering downwardly to substantially as high as the handle portion at the opposing side of the container, so as expose and make accessible the handle portion of the container; and (b) a base portion to substantially cover the base portion of the container to insulate the container contents; and a hole or plurality of holes penetrating the base portion of said shell to counteract vacuum effect when removing the container from said shell.

2. The enclosure of claim 1, wherein the material comprises foam rubber or foam plastic.

3. The enclosure of claim 2, wherein the material further comprises a vinyl-coating on top of said foam rubber or foam plastic.

4. The enclosure of claim 3, wherein the material is substantially one-half inch in thickness.

5. The enclosure of claim 1, wherein the main portion of said shell is substantially square in horizontal cross-section.

6. An enclosure for insulating a container which is non-circular in horizontal cross-section, the container being a half-gallon jug having a base portion, a main body portion, a mouth portion formed at one side of the container, an integral handle portion formed on an opposing side of the container, and a neck portion tapering downwardly from the mouth portion to the handle portion, said enclosure comprising:

a shell of insulating material shaped to hold the container, the shell having an interior space which is non-circular in horizontal cross-section and is of dimensions which substantially correspond to the exterior dimensions of the main body portion of the container, said shell comprising:

(a) a main portion to substantially cover the main body portion of the container to insulate the container contents, one side of the main portion of the shell extending substantially as high as the mouth portion of the container at said one side of the container, said main portion tapering downwardly to substantially as high as the handle portion at the opposing side of the container, so as expose and make accessible the handle portion of the container; and (b) a base portion to substantially cover the base portion of the container to insulate the container contents; and a hole or plurality of holes penetrating the base portion of said shell to counteract vacuum effect when removing the container from said shell.

7. The enclosure of claim 6, wherein the material comprises foam rubber or foam plastic.

8. The enclosure of claim 7, wherein the material further comprises a vinyl-coating on top of said foam rubber or foam plastic.

9. The enclosure of claim 8, wherein the material is substantially one-half inch in thickness.

10. The enclosure of claim 6, wherein the main portion of said shell is substantially square in horizontal cross-section.

* * * * *